United States Patent [19]

Burger

[11] 3,974,945

[45] Aug. 17, 1976

[54] AEROSOL DISPENSING SYSTEM

[75] Inventor: Norman Donald Burger, Culver City, Calif.

[73] Assignees: Norman D. Burger, Culver City; Nicholas Mardesich, Palos Verdes Estates, both of Calif. ; part interest to each

[22] Filed: Jan. 15, 1976

[21] Appl. No.: 649,523

Related U.S. Application Data

[63] Continuation-in-part of Ser. No. 544,390, Jan. 27, 1975, Pat. No. 3,983,708, which is a continuation-in-part of Ser. No. 497,613, Aug. 15, 1974, abandoned, which is a continuation-in-part of Ser. No. 446,140, May 2, 1974, abandoned.

[52] U.S. Cl. ..... 222/192

[51] Int. Cl.[2] ..... B67D 5/06

[58] Field of Search ..... 222/192, 3, 399

[56] References Cited

UNITED STATES PATENTS

| | | | |
|---|---|---|---|
| 1,608,155 | 11/1926 | Barnebey | 222/3 |
| 3,402,665 | 9/1968 | Torpley, Jr. et al. | 222/192 X |

*Primary Examiner*—Allen N. Knowles
*Assistant Examiner*—Hadd Lane
*Attorney, Agent, or Firm*—George F. Smyth

[57] ABSTRACT

An aerosol dispensing system having an outer container, compressible inner container means positioned within the outer container, and means to compress the inner container means which are positioned between the inner container means and the outer container. A spray head and valve assembly are connected to the inner container means such that movement of the valve assembly to an opened position permits material within the inner container means to be expelled through the spray head in the form of a finely divided aerosol spray.

The material within the inner container means includes a major amount of a finely divided powder product in admixture with a neutral propellant and a minor amount of an amorphous silica. The neutral propellant is capable of being adsorbed by the amorphous silica and the neutral propellant is present in amounts sufficient to form a substantially homogeneous wet-paste slurry or a substantially homogeneous liquid with the finely divided powder product and the amorphous silica. On opening of the valve assembly during discharge of product from the inner container means, the neutral propellant is at least partially vaporized during passage of the finely divided powder product and neutral propellant through the spray head with the vaporization of the neutral propellant generating a sufficient velocity within the spray head and valve assembly to form a finely divided aerosol spray composed of the finely divided powder product.

15 Claims, 1 Drawing Figure

AEROSOL DISPENSING SYSTEM

RELATED APPLICATIONS

This application is a continuation-in-part of my prior copending U.S. application Ser. No. 544,390, filed Jan. 27, 1975, now U.S. Pat. No. 3,983,708 of Feb. 17, 1976, which is in turn a continuation-in-part of my prior application Ser. No. 497,613, filed Aug. 15, 1974, and now abandoned, which is in turn a continuation-in-part of my prior application Ser. No. 446,140, filed May 2, 1974, and now abandoned.

BACKGROUND OF THE INVENTION

A wide variety of products are now packaged for dispensing as a finely divided aerosol spray and many of these products include a major amount of a finely divided powder such as talc, sodium bicarbonate, sodium carbonate, aluminum chlorohydrate, and the like. Products which contain a major amount of a finely divided powder may, for example, include antiperspirants, insecticides, and fire retardant compositions.

As disclosed in my prior copending U.S. patent application Ser. No. 544,390, it is now possible to dispense a fine spray of an aerosol product from a barrier-pack container. In accomplishing this result, a neutral propellant together with a relatively non-foaming liquid product or a finely divided powder product is contained within compressible inner container while means positioned between the inner container and an outer container are provided to compress the inner container means. A mechanical breakup spray head and valve assembly are connected to the inner container means and, during discharge of product, the neutral propellant is at least partially vaporized on passage of the product and neutral gas through the spray head.

By using the aerosol dispensing system described in my prior applications, it is now possible to eliminate a number of problems which have long plagued the aerosol industry. Among these problems are incompatibility of the propellant and product at high propellant-to-product volume ratios such as, for example, in the use of a liquified hydrocarbon propellant with a water base paint or in the use of a halogenated hydrocarbon propellant for a water base product. In my aerosol dispensing system, the product is discharged in conjunction with a relatively small amount of a neutral propellant from a compressible inner container positioned within an outer container. The force required for discharge of the product and neutral propellant in the form of a finely divided spray is provided by compression of the compressible inner container. Since the neutral propellant present in admixture with the product in my aerosol system does not function as a primary propellant (i.e., in generating a driving force to expel the product in the form of a finely divided spray), the quantity of neutral propellant may be maintained at a relatively low level with respect to the quantity of the product. This, then, avoids the compatibility problems which were previously experienced in conventional aerosol systems where the primary propellant and product are not separated and also permits the use of a greater quantity of product in an aerosol dispensing system.

In conventional aerosol dispensing systems, it has sometimes been necessary to employ a very large quantity of propellant to generate a driving force and to sufficiently dilute a relatively small quantity of a viscous product for discharge, such as a frying pan spray. In these prior conventional systems, the use of relatively high propellant-to-product volume ratios may make the aerosol product unattractive to the consumer who must purchase a relatively large quantity of propellant to obtain a relatively small quantity of product. In my aerosol dispensing system, as described in my prior U.S. patent applications, a larger quantity of product may be present since it is no longer necessary to dilute the product with gross quantities of propellant to dispense the product in the form of a fine spray. This provides a savings to the consumer who no longer has to purchase a large quantity of unwanted propellant to obtain a relatively small quantity of desired product in the form of an aerosol spray.

Additionally, in the use of my aerosol dispensing system, the use of a relatively minor quantity of a neutral propellant in admixture with the product has greatly reduced the problem of flammability that occurred in conventional aerosol systems when the propellant was a hydrocarbon. In such prior systems, the use of a relatively large quantity of a hydrocarbon propellant as required for a relatively thick or viscous product, could produce an aerosol spray that was highly flammable due to the concentration levels of hydrocarbon propellant within the spray. In my dispensing system, the neutral propellant which is discharged with the product is present in a relatively minor amount as compared with the amount of propellant employed in previous aerosol systems. Thus, when the neutral propellant is a hydrocarbon propellant, the concentration of hydrocarbon propellant in the aerosol spray is greatly reduced so that the spray itself may be much less flammable than the spray from prior aerosol systems utilizing a hydrocarbon propellant.

By the same token, toxicity problems which characterized prior conventional aerosol systems have been largely eliminated with my aerosol dispensing system since the quantity of neutral propellant that is discharged with the product is markedly reduced from the amount of propellant that was discharged during usage of previous aerosol systems. This advantage of my aerosol dispensing system is of particular importance in view of the increasing evidence that fluorocarbon propellants may pose a grave environmental hazard by reducing the ozone layer which surrounds the earth and which acts to absorb harmful solar radiation. In my aerosol dispensing system, the neutral propellant need not be a fluorocarbon propellant as was previously required in many conventional aerosol systems to avoid the problems of flammability and product incompatibility which characterized the use of hydrocarbon propellants. Thus, in my aerosol dispensing system, the neutral propellant which is discharged with the product may be completely non-toxic in addition to being discharged in only a relatively small quantity during use of the aerosol dispensing system.

As described in my prior copending U.S. application Ser. No. 544,390, a somewhat larger amount of a neutral propellant has been generally required in aerosol dispensing systems having a finely divided powder product than was required for aerosol dispensing systems in which the product has been a relatively non-foaming liquid. In systems where the product has been a finely divided powder, it was necessary that the neutral propellant be present in a sufficient amount to form a slurry with the product such that the product would have flow characteristics which assure its flow to the spray head during discharge of the product. In the case of a relatively non-foaming liquid product, a lesser quantity of neutral propellant could be utilized while providing suitable flow characteristics to the product which permitted it to flow to the spray head during discharge of the product.

SUMMARY OF THE INVENTION

The present invention is directed to an improvement of my previously described aerosol dispensing system as disclosed in my prior copending U.S. application Ser. No. 544,390. As disclosed in my prior copending application, an essential part of my aerosol dispensing system was the use of a mechanical breakup spray head since the use of a mechanical breakup spray head was believed essential to the obtaining of a finely divided aerosol spray. However, in the conduct of further research, it was found that my aerosol dispensing system could be modified through elimination of the mechanical breakup spray head if the product being discharged was a finely divided powder product having a particular composition. The present improvement, thus, makes possible the elimination of the mechanical breakup spray head from my previously described aerosol dispensing system when the product being discharged has a particular composition as will be described. This result is advantageous since it permits the use of a standard spray orifice in certain applications of my aerosol dispensing system, with a resultant reduction in the overall cost of the system.

In accord with the present invention, my aerosol dispensing system includes an outer container, a compressible inner container means positioned within the outer container, and means to compress the inner container means which is positioned between the inner container means and the outer container. Additionally, a spray head and valve assembly are connected to the inner container means to provide for the discharge of product from the inner container means through the spray head on opening of the valve assembly.

The product which is dispensed in accord with the present invention comprises a major amount of a finely divided powder product in admixture with a minor amount of an amorphous silica. Additionally, a liquified neutral propellant is present in admixture with the finely divided powder with the neutral propellant having the property of being adsorbed by the amorphous silica. The neutral propellant that is present within the inner container means is present in amounts which range from that required to form a substantially homogeneous wet paste-like slurry to an amount required to form a substantially homogeneous liquid with the neutral propellant being at least partially vaporized on passage of the product and neutral propellant through the spray head during opening of the valve assembly. By using the amorphous silica in admixture with the finely divided powder product, it has been found possible to obtain a more homogeneous mixture of the powder product and neutral propellant than was previously obtainable. Accordingly, when the product is then discharged from the compressible inner container means, the finely divided powder product is more uniformly carried through the spray head. This has permitted the modification of my previous aerosol dispensing system by elimination of the mechanical breakup spray head while still obtaining, in many instances, a finely divided aerosol spray through usage of the aerosol dispensing system.

BRIEF DESCRIPTION OF THE DRAWING

To further illustrate an embodiment of my invention, reference is made to the accompanying drawing in which.

DETAILED DESCRIPTION

Figure 1:
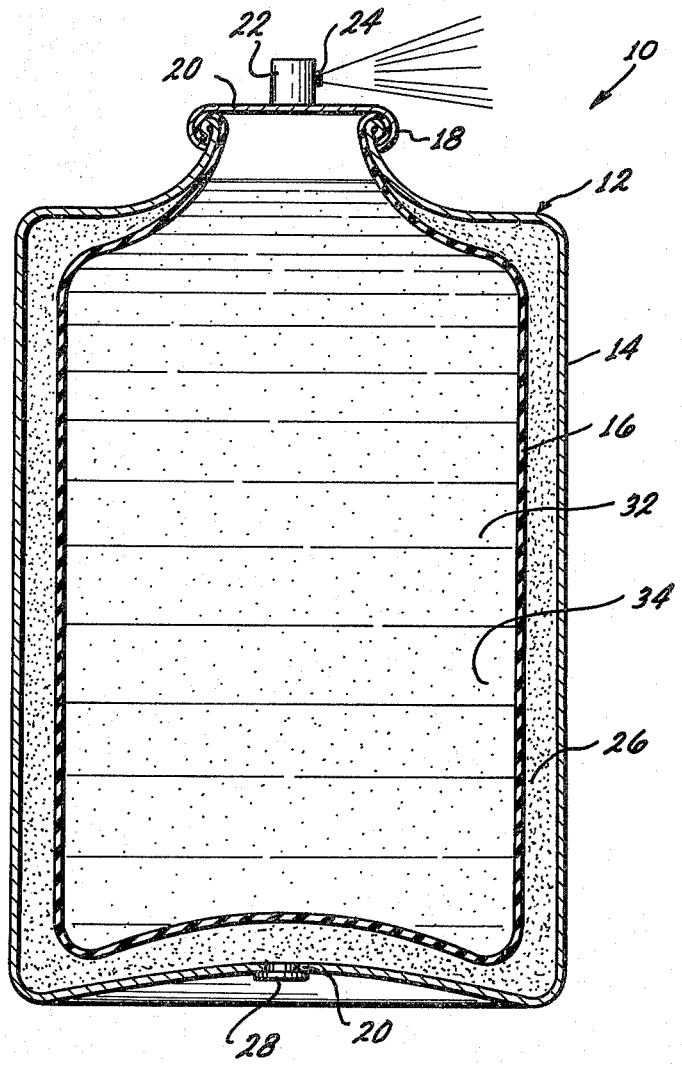
FIG. 1 is a vertical sectional view through a barrier pack aerosol dispensing container which embodies the principles of the present invention.

With reference to the drawing, there is illustrated an embodiment, generally designated 10, of an aerosol dispensing system according to the principles of the present invention. The aerosol dispensing system 10 may include a barrier pack container generally designated 12 having a rigid outer container 14 and a flexible bag or bladder 16 container therein. Instead of using a flexible bag 16, other forms of a compressible container means may be utilized such as a piston dispenser in which a piston is slidably received within a container with the product being placed on one side of the piston and means to compress the piston, such as a spring means or a propellant, being placed on the other side of the piston. Also, the compressible container means may be a resiliently expandable bag that is formed of an elastic material such that the bag in its expanded condition exerts a compressive force on a product within the bag which is sufficient to expel the product from the bag. The flexible bag or bladder 16 may be coupled to the rigid outer container 14 at the top 18 thereof in fluid-tight sealing relation by crimping a mounting cup 20 thereon. The mounting cup 20 may be part of a valve assembly 22 which includes a spray head 24 through which the aerosol dispersion may be dispensed.

Barrier pack containers are commercially available in various sizes and may be obtained, for example, from Continental Can Company. The valve assembly 22 is also a commercially available item and may be obtained from various manufacturers such as Precision Valve Corporation or Aerosol Research Company.

The dispensing head 24, in accord with the principles of the present invention, may be a mechanical breakup head characterized by the use of a swirl chamber within which the product is submitted to centrifugal force before ejection of the product through an orifice into the atmosphere. Also, the spray head 24 may be a standard type of orifice head in which the product is merely ejected through a metering orifice which may, for example, have an orifice opening of about 0.016 inches to about 0.030 inches.

A primary propellant generally designated 26 may be contained in the space between the flexible bag 16 and the rigid outer container 14 so as to exert a force upon the flexible bag. The primary propellant 26 may be retained therein by a stopper means 28 inserted in a fill aperture 30 within the rigid outer container 14.

The product to be dispensed 32 is contained within the flexible bag 16. The product includes a major amount of a finely divided powder which may be, for example, an antiperspirant powder, an insecticidal powder, or a fire retardant powder composition. In addition to the finely divided powder product present within the flexible bag 16, there is also present a finely divided amorphous silica and a neutral propellant generally designated 34 with the neutral propellant being adsorbed by the finely divided amorphous silica such that the propellant is uniformly distributed throughout the finely divided powder product.

According to the principles of the present invention, the primary propellant 26 may be essentially any propellant such as Freon-12, fluorinated hydrocarbons, vinyl chlorides, propane, isobutane, carbon dioxide, or the like. For example, the propellant 26 may be a mixture of isobutane and propane with such a mixture having a vapor pressure at 70°F. in the range of about 40 to about 80 psig. Since the propellant 26 does not come in contact with the product 32 contained within the flexible bag 16, any propellant is satisfactory which is compatible with the structure of the barrier pack 12.

Suitable neutral propellants, which are present in the flexible bag 16, may include, for example, propane, isobutane, n-butane, and the recently developed Freon-20 halohydrocarbons which purportedly do not have an adverse affect upon the earth's ozone layer.

As stated, the amorphous silica present within the flexible bag 16 functions to adsorb the neutral propellant 34. In general, the amorphous silica may be present within the range of about 5 to about 14 percent by weight of the concentrate within the flexible bag 16, which concentrate includes the amorphous silica, the finely divided powder product, and any other ingredients which may be present, such as an emollient that may be utilized when the aerosol product is an antiperspirant. More preferably, the finely divided amorphous silica is present in a concentration of about 10 to about 12 percent by weight of the concentrate. The content of the neutral propellant 34 which is present within the flexible bag 16 is critical to the present invention and must be controlled within specified limits to obtain flow of the aerosol product to the dispensing head 24 on opening of the valve assembly 22. When the neutral propellant 34 is added to the flexible bag 16, the neutral propellant is initially adsorbed by the amorphous silica such that the aerosol product retains its physical state of a dry powder. At concentrations of neutral propellant which permit the product to retain its physical state as a dry powder, the aerosol product does not flow properly to the dispensing head 24 and, additionally, the dry powder produces clogging of the discharge orifice in the dispensing head.

To obtain flow of the aerosol product through the dispensing head 24 in the form of a fine spray on opening of the valve assembly 22, it has been found necessary that the neutral propellant 34 must be present in a sufficient minimum amount to form a paste-like thick slurry with the concentrate within the flexible bag 16. While the content of neutral propellant 34 required to form a thick paste-like slurry with the concentrate within the flexible bag 16 may vary somewhat from one product to another, it has been found that, in general, the concentration of neutral propellant is about 20 to about 25 percent by weight of the total composition within the flexible bag (the concentrate plus the neutral propellant) when the neutral propellant is a hydrocarbon.

As the content of hydrocarbon neutral propellant within the flexible bag 16 is increased to concentrations in excess of that required to form a wet paste-like slurry with the concentrate, the physical form of the aerosol product within the flexible bag gradually changes from a wet paste-like slurry to a liquid. While the concentration of hydrocarbon propellant that is required to convert the aerosol product to a liquid form may vary from one product to another, the conversion of the aerosol product to a liquid state generally takes place at a concentration of hydrocarbon propellant of about 25 to about 30 percent of the total aerosol product. With the aerosol product, thus, converted to a liquid form, the spray head 24 is preferably a high mechanical breakup spray head since the use of a high mechanical breakup spray head is generally necessary to discharge the product as a finely divided aerosol spray when the product is in liquid form.

As the content of hydrocarbon propellant within the flexible bag 16 is increased still further to concentration levels in excess of that required to convert the aerosol product to a liquid form, a critical level of propellant is reached where the aerosol product separates into a solid component and a liquid component. This separation is very undesirable since the finely divided powder product is then not adequately carried to the spray head 24 during opening of the valve assembly 22. Further, in the separation of the aerosol product into a solid component and a liquid component, the spray head is more prone to clogging by the solid component of the aerosol product. For these reasons, it is essential to the present invention that the content of neutral hydrocarbon propellant not be sufficiently high to cause separation of the aerosol product into a solid component and a liquid component. In general, separation may occur at a hydrocarbon propellant concentration of about 30 to about 40 percent by weight of the total aerosol composition with the content of the hydrocarbon propellant required to cause separation varying to some extent from one aerosol composition to another.

The content of finely divided powder which is present in the total aerosol formulation contained within the flexible bag 16 may vary somewhat depending upon the nature of the aerosol product. In general, powder concentrations ranging from about 30 to about 72 percent by weight of the total aerosol formulation were found to be satisfactory. The powder product is, as stated, finely divided. The principal consideration in determining the desired particle size of the finely divided powder is the size of the discharge orifice in the discharge head 24 since, if the powder particles are larger than the size of the discharge orifice, clogging will occur. Thus, it is essential that the finely divided powder have a particle size which is smaller than the size of the discharge orifice in the discharge head 24. In general, powders which were utilized had a particle size of about 100 mesh or finer (U.S. Standard Screen Series).

When the aerosol formulation is an antiperspirant, the product may contain emollients in a suitable concentration to provide adhesion of the finely divided powder to the user's skin. The content of the emollients may, for example, range from about 10 percent or less up to as high as about 20 percent by weight of the concentrate within the flexible bag 16. Additionally, the concentrate may contain water in an amount ranging up to about 30 percent by weight.

When the neutral propellant 34 is a Freon propellant, such as the Freon-20 series of propellants, the neutral propellant is present in a higher concentration than in the case of a hydrocarbon neutral propellant. In general, the Freon propellants have a density in the order of two to three times the density of a hydrocarbon propellant. Accordingly, the concentration of a neutral fluorocarbon propellant 34 is about two to three times the concentration by weight of a hydrocarbon propellant as discussed previously. When the neutral propellant 34 is a mixture of a Freon propellant with a hydrocarbon propellant, the concentration of the propellant mixture may be at a level which is intermediate the concentration required for a hydrocarbon neutral propellant and that required for a Freon neutral propellant.

Among the finely divided powders which may be present within the propellant formulation are sodium bicarbonate, talc, cornstarch, and the like. Additionally, when the propellant formulation is an antiperspirant, aluminum chlorohydrate is present in an effective amount to inhibit perspiration by the user. Aluminum chlorohydrate is a skin irritant at relatively high concentrations and, thus, aluminum chlorohydrate is incorporated into an antiperspirant composition in conjunction with other powders which reduce the concentration of aluminum chlorohydrate.

In conventional antiperspirant compositions (i.e., where the primary propellant and product are discharged together in an aerosol spray) a typical concentration of aluminum chlorohydrate may be in the order of about 5 percent by weight with the primary propellant being present in an amount of about 95 percent by weight. However, in antiperspirant compositions which may be dispensed in accord with the present invention, the total content of aluminum chlorohydrate may be increased considerably due to the fact that the total weight of product may be greatly increased as compared with the weight of product that may be dispensed from a conventional aerosol system. For example, the content of aluminum chlorohydrate utilized in an antiperspirant formulation dispensed with the present aerosol system may range to as high as about 10 to about 20 percent by weight of the total propellant formulation (including the neutral propellant) in conjunction with other finely divided powders which act as diluents to prevent skin irritation from the aluminum chlorohydrate.

When the aerosol formulation dispensed according to the present invention is a plant treatment composition, such as a fungicide or an insecticide, the active ingredient is present in an amount that is effective for the intended purpose of the composition, e.g., to kill insects or to eradicate a plant fungus. Additionally, other powder ingredients are also present to control the toxicity of the actove ingredient at a level which is not harmful to man when the propellant formulation is discharged onto plants or insects.

In the case of fire extinguisher formulations, essentially all of the finely divided powder in the formulation may be an active fire retardant since an active fire retardant powder is generally not toxic and, thus, does not need to be diluted through the inclusion of other ingredients. By way of example, sodium bicarbonate is an active fire retardant. Thus, in an aerosol formulation according to the present invention for use as a fire extinguisher, all of the finely divided powder in the product may be sodium bicarbonate.

By way of example, a typical concentrate for an antiperspirant in accord with the present invention is set forth in the following Table I in which all parts and percentages are by weight:

TABLE I

| | | |
|---|---|---|
| Baking soda (sodium bicarbonate) | | 30 parts |
| Aluminum chlorohydrate | | 21.6 parts |
| Amorphous silica | (grade M-5 Cab-O-Sil - a trademark product of Cabot Corporation) | 9 parts |
| Cornstarch | | 21.5 parts |

TABLE I-continued

| | |
|---|---|
| Absolute ethyl alcohol | 8.6 parts |
| Isopropyl palmitate or Isopropyl myristate | 9.5 parts |

In use of a typical antiperspirant concentrate, as set forth in Table I, the concentrate may be placed inside of the flexible bag or bladder 16 with a neutral propellant 34 then being added in sufficient amounts to form a substantially homogeneous wet paste-like slurry or a substantially homogeneous liquid, as described previously. When the neutral propellant 34 is a hydrocarbon propellant, the baking soda which is present in the formulation may serve several functions. First, the baking soda is a weighting agent which serves to dilute the aluminum chlorohydrate such that the antiperspirant composition is not irritating to the user's skin. Second, the baking soda serves as a fire retardant to reduce the flammability of the finely divided aerosol spray as it emerges from the spray head 24. Lastly, baking soda is a reasonably good adsorbent in its own right. Thus, the baking soda serves, along with the amorphous silica, in adsorbing the neutral propellant which is added to the concentrate in making up the aerosol formulation.

When a finely divided powder which is not a good adsorbent is substituted for baking soda in the aerosol formulation, the content of finely divided amorphous silica may be increased somewhat to insure that the neutral propellant 34 is adsorbed in providing a substantially homogeneous wet paste-like slurry or a substantially homogeneous liquid. Talc is not a good adsorbent and cornstarch, although a better adsorbent than talc, is not as good an adsorbent as baking soda. Aluminum chlorohydrate is a somewhat better adsorbent than cornstarch, but is not as good an adsorbent as baking soda. Accordingly, depending upon the particular finely divided powder which is present in the aerosol formulation, the content of amorphous silica may be varied in the manner described to provide generally uniform adsorption of the added neutral propellant 34.

When the aerosol product contains water, an amorphous silica may be utilized which has the property of surrounding the particles of the finely divided powder ingredients such that water is not absorbed by the finely divided powder. By way of example, the pyrogenic silica may, in this case, be Tullanox 500 or Silanox 101, both of which are trademark products sold by Tulco Inc.

As stated in my prior copending U.S. application Ser. No., 544,390, the differential pressure across the flexible bag 16 may be varied in my aerosol dispensing system depending upon the delivery rate of product which is desired. Also, a vapor depressant may be present within the flexible bag 16, in which case the neutral propellant 34 may be the same as the primary propellant 26. Through rapid evaporation of an unvaporized neutral propellant 34 after leaving the orifice of the spray head 24, the product may contain little or no neutral propellant when it contacts the surface or object against which it is sprayed. This is advantageous in a personal use product, such as an antiperspirant, since the product may then be in an essentially dry state when it contacts the user's body. The disclosure of my prior copending application Ser. No. 544,390 is incorporated herein by reference since this application contains a very thorough discussion of the various parameters which are involved in the general usage of my aerosol dispensing system.

I claim:

1. An aerosol dispensing system comprising:

an outer container;

compressible inner container means positioned within said outer container;

means to compress said inner container means positioned between said inner container means and said outer container;

a spray head and valve assembly connected to said inner container means;

a major amount of a finely divided powder product within said inner container means;

a minor amount of an amorphous silica within said inner container means;

a liquified neutral propellant within said inner container means;

said neutral propellant being adsorbable by said silica;

said neutral propellant being present in an amount sufficient to form a substantially homogeneous wet paste-like slurry or a substantially homogeneous liquid with said powder product and amorphous silica, and said neutral propellant being at least partially vaporized on passage of the product and neutral propellant through said spray head.

2. The aerosol dispensing system of claim 1 wherein said neutral propellant is a hydrocarbon propellant.

3. The aerosol dispensing system of claim 2 wherein said propellant is present in an amount of about 20 to about 35 percent by weight.

4. The aerosol dispensing system of claim 1 wherein said amorphous silica is present in an amount of about 5 to about 14 percent by weight of the total solids.

5. The aerosol dispensing system of claim 2 wherein said propellant is present in an amount of about 25 to about 28 percent by weight.

6. The aerosol dispensing system of claim 1 wherein said product contains aluminum chlorohydrate in an amount which is effective to retard perspiration.

7. The aerosol dispensing system of claim 6 including an emollient within said inner container means, and said emollient being present in an amount up to about 7 percent by weight of the total solids which is effective to provide adhesion of the powder product to the skin.

8. The aerosol dispensing system of claim 1 including a minor amount of water within said inner container means.

9. The aerosol dispensing system of claim 2 wherein said neutral propellant is propane, isobutane, n-butane or a mixture thereof.

10. The aerosol dispensing system of claim 1 wherein said powder product is a flame retardant.

11. The aerosol dispensing system of claim 1 wherein said powder product includes an active insecticide, and said insecticide is present in an insecticidally effective amount.

12. The aerosol dispensing system of claim 1 wherein said neutral propellant is present in an amount sufficient to form a substantially homogeneous liquid, and said spray head is a high mechanical breakup spray head.

13. The aerosol dispensing system of claim 1 including aluminum chlorohydrate within said inner container;

the total content of powder product ranging from about 45 to about 75 percent by weight, and said aluminum chlorohydrate being present in an amount of about 10 to about 20 percent by weight, whereby said system has an increased use life and contains a larger quantity of a perspiration inhibitor.

14. The aerosol dispensing system of claim 1 wherein said neutral propellant is a fluorocarbon which does not interfere with the earth's ozone layer during breakdown of the fluorocarbon.

15. The aerosol dispensing system of claim 1 including a primary propellant within the region between said outer container and said inner container means, and said primary propellant having a vapor pressure and being present in an amount sufficient to maintain a pressure on the inner container means which is suffficient to compress the inner container means and to expell the powder product, amorphous silica and neutral propellant through the spray head on opening of said valve to produce a finely divided spray.

* * * * *